US005454962A

United States Patent [19]

Slama et al.

[11] Patent Number: 5,454,962

[45] Date of Patent: Oct. 3, 1995

[54] FLUOROELASTOMER-FRIENDLY CRANKCASE AND DRIVETRAIN LUBRICANTS AND THEIR USE

[75] Inventors: Francis J. Slama, Montgomery; Paula R. Vettel, Downers Grove, both of Ill.

[73] Assignee: Ethyl Petroleum Additives, Inc., Richmond, Va.

[21] Appl. No.: 82,991

[22] Filed: Jun. 25, 1993

[51] Int. Cl.[6] ..... C10M 133/52

[52] U.S. Cl. ..... 252/51.5 A; 252/49.6

[58] Field of Search ..... 252/51.5 A

[56] References Cited

U.S. PATENT DOCUMENTS

| | | | |
|---|---|---|---|
| 3,272,746 | 9/1966 | LeSuer et al. | 252/51.5 A |
| 3,341,542 | 9/1967 | LeSuer et al. | 252/51.5 A |
| 4,908,145 | 3/1990 | Fenoglio | 252/51.5 A |
| 4,940,552 | 7/1990 | Cengel et al. | 252/51.5 A |
| 5,080,815 | 1/1992 | Fenoglio et al. | 252/51.5 A |
| 5,174,915 | 12/1992 | Hutchison et al. | 252/51.5 A |

*Primary Examiner*—Ellen M. McAvoy

*Attorney, Agent, or Firm*—Dennis H. Rainear; William H. Thrower

[57] ABSTRACT

Dispersancy and fluoroelastomer seal compatibility are achieved by use in the lubricant of a dispersing amount of a product made by reacting aminoguanidine or a basic salt thereof with a hydrocarbyl-substituted succinic acid or anhydride in a mole ratio of from about 0.4 to about 1.2 moles of the aminoguanidine or basic salt thereof per mole of the succinic acid or anhydride compound.

17 Claims, No Drawings

FLUOROELASTOMER-FRIENDLY CRANKCASE AND DRIVETRAIN LUBRICANTS AND THEIR USE

BACKGROUND

Internal combustion engines and drivetrains operate under a wide range of temperatures including low temperature stop-and-go service, as well as high temperature conditions produced by continuous high speed driving. Sludges or insolubles are produced under some operating conditions and dispersants are added to the lubricating oil so that potentially insoluble materials remain dispersed in the oil.

It is known to employ nitrogen-containing dispersants in the formulation of crankcase and drivetrain lubricating oil compositions. Many of the known dispersants are based on the reaction of an alkenyl succinic acid or anhydride with an amine or polyamine to produce an alkenyl succinimide.

Flexible engine seals are used in assembling internal combustion engines and drivetrains to prevent leakage of lubricants at locations where moving parts, such as crankcase shafts, extend outside the engine block. Accordingly, qualification tests have been established whereby the effect of a lubricant composition on seal-type materials is measured under a particular set of controlled laboratory bench test conditions. One such test measures the compatibility of the lubricant with a specified fluoroelastomer, namely, VITON fluoroelastomer. This is a special test material that has been developed for use in the fluoroelastomer seal tests. The material is intended to simulate the proprietary seal materials in actual use by the original equipment manufacturers. Thus the commercial reality is that the lubricant must exhibit good performance in the test in order to achieve acceptance in the marketplace.

U.S. Pat. No. 5,080,815 to Fenoglio et al describes dispersants having improved compatibility toward the fluorohydrocarbon-containing elastomer. Those dispersants are formed by reacting a hydrocarbyl-substituted dicarboxylic acid compound such as a hydrocarbyl-substituted dicarboxylic acid anhydride with aminoguanidine or a basic salt thereof in a ratio of about 1.4 to about 2.2 moles of aminoguanidine or basic salt thereof per mole of hydrocarbyl-substituted dicarboxylic acid compound.

U.S. Pat. No. 4,908,145 to Fenoglio describes dispersants for lubricating oils that are also compatible with the fluorohydrocarbon elastomer. These dispersants are enriched in alkyl-bis-3-amino- 1,2,4-triazole (e.g., polybutenyl-bis-3-amino-1,3,4-triazoles) and are formed by reacting an alkyl-substituted dicarboxylic acid compound, such as a polyisobutenyl succinic acid compound, with a basic salt of aminoguanidine at a ratio of from about 1.6 to about 2 moles of aminoguanidine compound per mole of the alkyl-substituted dicarboxylic acid compound.

Both of the foregoing patents show in Table II thereof that dispersants made in accordance with their teachings exhibited good compatibility with VITON fluoroelastomer in the Caterpillar VITON Compatibility Test. These patents also show results of spot dispersancy bench tests which indicate that a product prepared by reacting one mole of aminoguanidine bicarbonate per mole of polyisobutenyl succinic anhydride was relatively ineffective as a dispersant.

THE INVENTION

The present invention provides a superior way of providing fluoroelastomer seal compatibility using a nitrogen-containing dispersant in crankcase and drivetrain lubricants. The invention further provides a way of providing surprisingly effective dispersancy and superior fluoroelastomer seal compatibility.

In accordance with one embodiment of this invention, there is provided a method of providing fluoroelastomer seal compatibility and dispersancy which comprises operating an internal combustion engine or drivetrain having at least one fluoroelastomer surface exposed to the crankcase lubricant with a crankcase or drivetrain lubricant containing a dispersing-amount of a product made by reacting aminoguanidine or a basic salt thereof with a hydrocarbyl-substituted succinic acid or anhydride in a mole ratio of from about 0.4 to about 1.2 moles of the aminoguanidine or basic salt thereof per mole of the succinic acid or anhydride compound. Surprisingly, the use of such dispersants provides much better fluoroelastomer compatibility than the dispersants described in the above Fenoglio and Fenoglio et al patents. Moreover, despite the clear indication in those patents that products formed at reactant ratios below 1.4 moles of the aminoguanidine compound per mole of the succinic acid ester or anhydride compound would exhibit relatively poor dispersancy, it has been found, surprisingly, that under actual service conditions of engine operation, lubricants containing such products are at least as effective as the Fenoglio and Fenoglio et al dispersants.

Still another advantage of the present invention is that the fluoroelastomer-friendly dispersants used pursuant to this invention are less expensive than the dispersants described in the Fenoglio and Fenoglio et al patents.

It has also been discovered pursuant to this invention that use in crankcase or drivetrain lubricants of a borated product resulting from reaction of aminoguanidine or a basic salt thereof with a hydrocarbyl-substituted succinic acid or anhydride in a mole ratio of from about 0.4 to 1.2 moles of the aminoguanidine or basic salt thereof per mole of the succinic acid or anhydride compound results in still further fluoroelastomer compatibility.

For convenience, the term "AG dispersant" is used to designate a product made by reacting aminoguanidine or a basic salt thereof with a hydrocarbyl-substituted succinic acid or anhydride in a mole ratio of from about 0.4 to 1.2 moles of the aminoguanidine or basic salt thereof per mole of the succinic acid or anhydride compound. Likewise, the term "borated AG dispersant" is used to designate a product made in two stages, namely, (i) reacting aminoguanidine or a basic salt thereof with a hydrocarbyl-substituted succinic acid or anhydride in a mole ratio of from about 0.4 to 1.2 moles of the aminoguanidine or basic salt thereof per mole of the succinic acid or anhydride compound; and (ii) borating the product so produced.

In another of its forms this invention involves the use of AG dispersant and/or borated AG dispersant in an oil of lubricating viscosity in order to provide fluoroelastomer seal compatibility properties. Yet another embodiment of this invention is the use of AG dispersant and/or borated AG dispersant to confer fluoroelastomer compatibility properties upon a lubricating oil.

The above and other embodiments of this invention will become apparent from the ensuing description and appended claims.

To prepare the AG dispersant, a suitably proportioned mixture of an aliphatic hydrocarbyl-substituted succinic acid derivative (acid, anhydride, lower alkyl ester, or acyl halide) and aminoguanidine or a basic salt thereof is heated, preferably under an inert atmosphere, at a temperature in the range of about 120° to about 250° C. Preferably the reaction is conducted in an inert diluent such as a light mineral oil.

Reaction times are typically in the range of from 1 to 4 hours. Suitable inert atmospheres include nitrogen, argon, krypton, neon, etc. As noted above, it is required pursuant to this invention, to employ a product made using from about 0.4 to 1.2 moles of aminoguanidine or basic salt thereof per mole of the aliphatic hydrocarbyl-substituted succinic acid derivative.

In order to prepare borated AG dispersant, AG dispersant formed as above is heated in combination with a suitable boron-containing material such that the resultant product contains up to about 1% by weight of boron. Temperatures in the range of about 140° to about 200° C. are generally satisfactory for use in the boration reaction. Suitable methods for conducting boration are well known to those skilled in the art. See in the connection, U.S. Pat. Nos. 3,087,936; 3,254,025; 3,322,670; 3,344,069; 4,080,303; 4,426,305; 4,925,983 and 5,114,602, the entire disclosure of each of which is incorporated herein.

AG dispersants are characterized by having a peak in the region of 1590 $cm^{-1}$. Additionally, the spectrum may exhibit a peak in the range of 1690 $cm^{-1}$, but AG dispersants can be used that do not exhibit this latter peak. When made at moles ratios of about 1:1 or lower, a peak at 1725 $cm^{-1}$ appears. The 1590 $cm^{-1}$ peak is nearly absent in the Examples of U.S. Pat. No. 5,080,815. The chemical structure of the products of this invention is unknown, but on the basis of their infrared spectra, they do not appear to have any significant content of triazole moieties, as is shown by the absence of the 1640 $cm^{-1}$ IR peak present in the Examples of U.S. Pat. No. 5,080,815.

Methods are known for producing suitable aliphatic hydrocarbyl-substituted succinic acid derivatives (acid, anhydride, lower alkyl ester, or acyl halide), such as alkenyl succinic anhydrides, to be used in reaction with aminoguanidine or basic salts thereof. Reference may be had, for example, to U.S. Pat. Nos. 4,234,435; 4,908,145; 5,080,815; 5,071,919 and 5,137,978, the entire disclosure of each of which is incorporated herein.

The synthesis of typical AG dispersants and borated AG dispersants are set forth in the following examples.

EXAMPLE 1

Into a reaction vessel are charged 1665 g (0.47 mole) of 60% active polyisobutenyl succinic anhydride (PSA) (formed from polyisobutylene having a number average molecular weight of about 2060), 76.8 g (0.56 mole) of 98.5% aminoguanidine bicarbonate (AGB), and 600 g of a 100 neutral base oil. The mole ratio of AGB to PSA is 1.2:1. The mixture is heated at 170° C. under a nitrogen sweep for 2 hours with stirring. The product is filtered while hot and allowed to cool.

EXAMPLE 2

The procedure of Example 1 is repeated using a chemically equivalent amount of PSA formed from polyisobutylene having a number average molecular weight of about 1290 in lieu of the higher molecular weight PSA of Example 1.

EXAMPLE 3

The procedure of Example 1 is repeated except that the AGB:PSA mole ratio is 1.1:1.

EXAMPLE 4

Example 3 is repeated except that the PSA of Example 2 is employed.

EXAMPLE 5

Product formed as in Example 3 is borated by heating 2290 g of the 44% active product so formed with 28.6 g of boric acid at 160° C. for 2 hours. The resultant borated product contains 0.2% boron.

EXAMPLE 6

Example 5 is repeated, but using 2000 g of product formed as in Example 4. The boron content of the borated product is 0.2%.

EXAMPLE 7

Product formed as in Example 1 is borated by heating 2290 g of the active product so formed with 72.1 g of boric acid at 160° C. for 2 hours. The resultant borated product contains 0.5% boron.

EXAMPLE 8

Example 7 is repeated with the exception that 2000 g of active product formed as in Example 2 is used instead of the higher molecular weight product of Example 1.

EXAMPLES 9–15

The procedure of Example 1 is repeated seven times in the same manner except that the proportions of AGB and PSA are varied such that the respective AGB:PSA mole ratios are 0.4:1, 0.5:1. 0.6:1, 0.7:1, 0.8:1, 0.9:1 and 1:1.

EXAMPLES 16–22

Examples 9–15 are repeated, but using product formed as in Example 2 in place of the product formed as in Example 1.

EXAMPLES 23–36

The respective products formed as in Examples 9–22 are borated to boron levels of 0.2% using the boration procedure of Example 5.

EXAMPLE 37

Example 1 is repeated except that 1.0 mole of AGB is reacted with 0.8 mol of PSA. Boration is carried out as described in Example 5. An additional 0.2 mole of PSA is then added to the borated reaction product and the mixture is reacted at 170° C. for 2 hours to provide a preferred product of this invention.

An embodiment of this invention involves conducting a process in the manner illustrated by Example 37 above. This process involves a preliminary reaction between AGB and PSA followed by a second addition of PSA for further reaction with the product initially formed. The process of including a divided or second addition wherein the reactants are suitably proportioned yields a product that tends to have improved characteristics, namely a product that filters more rapidly than a corresponding product in which all of the PSA is reacted with the AGB in a single stage. To illustrate, a product formed as in Example 37 having an AGB to PSA ratio of 1:1 gives a product that filters faster than the corresponding product produced as in Example 15 or the borated product of Example 36. Additionally, the process of including a second stage addition of the polyisobutenyl succinic anhydride to the PSA-AGB product formed in the initial stage gives products where the 1690 $cm^{-1}$ band in the infrared spectrum decreases in intensity and the 1725 $cm^{-1}$ band increases in intensity.

The AG dispersants and borated AG dispersants are used in natural and in synthetic lubricating oils, or suitable blends thereof. Thus the base oils can be hydrocarbon oils of lubricating viscosity derived from petroleum (or tar sands, coal, shale, etc.). Likewise, the base oils can be or include natural oils of suitable viscosities such as rapeseed oil, etc., and synthetic oils such as hydrogenated polyolefin oils; poly-α-olefins (e.g., hydrogenated or unhydrogenated α-olefin oligomers such as hydrogenated poly-1-decene); alkyl esters of dicarboxylic acids; complex esters of dicarboxylic acid, polyglycol and alcohol; and the like. Mixtures of mineral, natural and/or synthetic oils in any suitable proportions are also useable. In most cases the base oil is preferably a petroleum-derived mineral oil of the types conventionally used in forming passenger car, heavy duty diesel engine oils, or drivetrain lubricants.

An effective amount of the AG dispersant and/or borated AG dispersant in the lubricant for dispersancy and fluoroelastomer compatibility is an amount ranging from about 0.5 to about 7 percent by weight based on the total weight of the finished lubricant. This concentration range is set forth in terms of the active content of the dispersant—i.e., the weight of diluent oil or other diluents that may be associated with the AG dispersant and/or borated AG dispersant is excluded from the calculation.

The finished lubricants used pursuant to this invention are formulated for use as crankcase lubricating oils for either passenger car service or heavy duty diesel engine service, or as drivetrain lubricants. Thus they will contain typical additives used in formulating such engine oils. These include low-base and overbased alkali and/or alkaline earth metal detergents, such as the sulfonates, sulfurized phenates and salicylates of lithium, sodium, potassium, calcium and/or magnesium; antiwear and/or extreme pressure agents such as metal salts of dihydrocarbyl dithiophosphoric acids (e.g., zinc, copper or molybdenum dialkyldithiophosphates); oxidation inhibitors such as hindered phenolic antioxidants, aromatic amine antioxidants, and copper-containing antioxidants; supplementary dispersants such as succinimide dispersants, succinic ester-amide dispersants, and Mannich base dispersants; friction reducing and/or fuel economy improving additives such as glycerol monooleate, pentaerythritol monooleate, long chain acid esters of glycols, sulfurized olefins, sulfurized unsaturated fatty acids and sulfurized unsaturated fatty acid esters; rust and corrosion inhibitors; foam inhibitors; viscosity index improvers; polymeric dispersant-viscosity index improvers; demulsifying agents; and the like. Such additives can be employed in the base oil at their customary use concentrations, which are known to those skilled in the art and reported in numerous patent disclosures. For further details concerning such additives, one may refer for example to U.S. Pat. Nos. 4,664,822; 4,908,145; 5,080,815 and 5,137,980, the entire disclosure of each of which is incorporated herein by reference. In the practice of this invention any crankcase lubricant containing any combination of any additives can be used, subject only to the provisos that (i) the lubricant contains a dispersant amount of the AG dispersant and/or the borated AG dispersant, and (ii) the makeup of the overall lubricant is such that no component(s) thereof unduly interfere(s) with either the dispersant effectiveness or the fluoroelastomer compatibility of the AG dispersant and/or the borated AG dispersant used therein.

The surprising advantageous results achievable by the practice of this invention were demonstrated by various standard tests. The unexpectedly great effectiveness achievable in dispersancy was demonstrated in two different sets of engine tests, namely the API Sequence VE test, and the Volkswagen VW 1431 engine test. In the VE tests three fully formulated crankcase lubricants were tested. These were identical in all respects except for the dispersant present therein. The finished crankcase lubricant used pursuant to this invention (Oil C) contained 5% by weight of AG dispersant formed as in Example 15 above wherein the AGB:PSA mole ratio was 1;1. Comparative Oils A and B contained 5% by weight of dispersants made in the same way as that in Oil C using the same PSA and the same AGB as that of Oil C, the only difference being that the mole ratio of AGB:PSA in Oil A was 1.9:1 pursuant to Fenoglio U.S. Pat. No. 4,908,145, and in Oil B was 1.4:1 pursuant to Fenoglio et al U.S. Pat. No. 5,080,815. Table I summarizes the results of these tests.

TABLE I

| Crankcase | AGB:PSA | VE Results | |
|---|---|---|---|
| Lubricant | Mole Ratio | Avg. Sludge | Avg. Varnish |
| Oil A | 1.9:1 | 9.10 | 5.91 |
| Oil B | 1.4:0 | 9.35 | 5.36 |
| Oil C | 1.0:1 | 9.42 | 5.54 |

Table I shows that the use of an AG dispersant pursuant to this invention gave excellent dispersant performance under actual engine operating conditions. In light of the teachings and showings in the Fenoglio and Fenoglio et al patents, these results could not have been expected.

In the second series of actual engine tests, another group of fully formulated crankcase lubricants was used. Here the three test lubricants were identical except that they contained 7% by weight of the respective dispersants used in these tests. As in the case of the dispersants used in Oils A, B and C above, the dispersants were made in the same way using the same PSA and the same AGB, the only difference being in the mole ratio of AGB:PSA used. In Oil D the mole ratio was 2.0:1 pursuant to Fenoglio U.S. Pat. No. 4,908,145, in Oil E it was 1.4:1 pursuant to Fenoglio et al U.S. Pat. No. 5,080,815, and in Oil F it was 1:1 in accordance with this invention. Thus Oils D and E are comparative runs, whereas Oil F was used in accordance with this invention. The test procedure used in this series of tests was the VW 1431 test. The results are summarized in Table II.

TABLE II

| Crankcase Lubricant | Mole Ratio AGB:PSA | Avg. Piston Merit |
|---|---|---|
| Oil D | 2.0:1 | 61 |
| Oil E | 1.4:1 | 57 |
| Oil F | 1.0:1 | 60 |

Here again, engine test results have shown that the dispersancy effectiveness of an AG dispersant was excellent. Such results could not have been anticipated in view of the teachings and data presented in the above Fenoglio and Fenoglio et al patents.

A standard elastomer compatibility test was used in order to evaluate fluoroelastomer compatibility of various lubricant compositions. In accordance with the test procedure, test pieces of VITON fluoroelastomer were exposed to individual test lubricants under the specified test conditions, and the change in tensile strength of the respective test pieces before and after such exposure was determined. Thus the smaller the change, the better.

Five different lubricating oil compositions were used pursuant to this invention (Oils G, H, I, J and K). These were blends of different AG dispersants or borated AG dispersants in individual portions of the same blend of mid-continent mineral oil basestocks. The AG dispersants (Oils G and H) and borated AG dispersants (Oils I, J and K) were made from a PSA produced from a commercially available polyisobutene having a number average molecular weight of about 2000. The borated AG dispersants each had a boron content of 0.2% by weight. The AGB:PSA mole ratios for all five dispersants used pursuant to this invention are set forth in Table III, which also summarizes the test results in terms of percent change in fluoroelastomer tensile strength experienced during the test. For comparison, Table III additionally shows the results of two different non-borated dispersants (Prior Art 1 and 2) and two different borated dispersants (Prior Art 3 and 4) made in accordance with the Fenoglio and Fenoglio et al patents. All tests were run in the same base oil and at the same dispersant concentration (7% by weight). The Prior Art dispersants 3 and 4 had boron contents of 0.2% by weight, and all of the Prior Art dispersants were made using the same PSA and AGB as used in the dispersants of Oils G through K.

TABLE III

| Composition | Mole Ratio AGB:PSA | Tensile Strength Change |
|---|---|---|
| Oil G | 0.9:1 | 2% |
| Oil H | 1.1:1 | <1% |
| Oil I | 0.7:1 | −5% |
| Oil J | 0.9:1 | 8% |
| Oil K | 1.1:1 | 4% |
| Prior Art 1 | 1.4:1 | 27% |
| Prior Art 2 | 1.6:1 | 25% |
| Prior Art 3 | 1.4:1 | 20% |
| Prior Art 4 | 1.6:1 | 21% |

The improvements in fluoroelastomer compatibility achieved pursuant to this invention as illustrated by the data in Table III are remarkable, in view of the fact that the triazole dispersants of the Fenoglio and Fenoglio et al patents are among the least antagonistic toward fluorocarbon seals of prior art nitrogen-containing ashless dispersants. The superiority of the dispersants used in the practice of this invention was unforeseeable prior to this test work.

This invention is susceptible to considerable variation in its practice. Accordingly, this invention is not intended to be limited by the specific exemplifications set forth hereinabove. Rather, this invention is intended to embrace the subject matter within the spirit and scope of the appended claims and the permissible equivalents thereof.

We claim:

1. A method of providing fluoroelastomer compatibility and dispersancy which comprises operating an internal combustion engine having at least one fluoroelastomer surface exposed to the crankcase or drivetrain lubricant, characterized in that the crankcase or drivetrain lubricant present therein contains a dispersing amount of a product made by reacting aminoguanidine or a basic salt thereof with a hydrocarbyl-substituted succinic acid or anhydride in a mole ratio of from about 0.4 to about 1.2 moles of the aminoguanidine or basic salt thereof per mole of the succinic acid or anhydride compound.

2. The method according to claim 1 wherein said product is a borated product.

3. The method according to claim 1 wherein said product is an unborated product.

4. The method according to claim 1 wherein said product yields an infrared spectrum which has a peaks at 1590 $cm^{-1}$.

5. The method according to claim 4 wherein said infrared spectrum also has a peak at 1725 $cm^{-1}$.

6. The method according to claim 1 wherein said at least one fluoroelastomer surface is exposed to crankcase lubricant containing a dispersing amount of said product.

7. The method according to claim 1 wherein said hydrocarbyl-substituted succinic acid or anhydride is reacted with the aminoguanidine or basic salt thereof in two stages whereby a portion of the hydrocarbyl-substituted succinic acid or anhydride is reacted with the aminoguanidine or basic salt thereof in a first stage reaction, and wherein the remainder of the hydrocarbyl-substituted succinic acid or anhydride is then added to the reaction product so formed and caused to react therewith in a second stage reaction.

8. The method of claim 4 wherein the product is borated.

9. The method of claim 5 wherein the product is borated.

10. A method of providing fluoroelastomer seal compatibility properties in an engine or drivetrain in which a fluoroelastomer is exposed to an oil of lubricating viscosity, which method comprises adding to said engine or drivetrain as said oil of lubricating viscosity, an engine or drivetrain lubricating oil that contains a dispersing amount of a product made by reacting aminoguanidine or a basic salt thereof with a hydrocarbyl-substituted succinic acid or anhydride in a mole ratio of from about 0.4 to about 1.2 moles of the aminoguanidine or basic salt thereof per mole of the succinic acid or anhydride compound.

11. The method according to claim 10 wherein said product is a borated product.

12. The method according to claim 10 wherein said product is an unborated product.

13. The method according to claim 10 wherein said product yields an infrared spectrum which has a peak at 1590 $cm^{-1}$.

14. The method according to claim 13 wherein said infrared spectrum also has a peak at 1725 $cm^{-1}$.

15. The method according to claim 10 wherein said oil of lubricating viscosity is a crankcase lubricating oil.

16. The method of claim 13 wherein the product is borated.

17. The method of claim 14 wherein the product is borated.

* * * * *